US009327328B1

(12) United States Patent
Ceballos, Sr.

(10) Patent No.: US 9,327,328 B1
(45) Date of Patent: May 3, 2016

(54) PNEUMO-HYDRAULIC SYSTEM FOR REPAIRING TRANSPORTATION CONTAINERS

(71) Applicant: Orlando Ceballos, Sr., Hialeah, FL (US)

(72) Inventor: Orlando Ceballos, Sr., Hialeah, FL (US)

(73) Assignee: Orlando Ceballos, Sr., Hialeah, FL (US)

( * ) Notice: Subject to any disclaimer, the term of this patent is extended or adjusted under 35 U.S.C. 154(b) by 0 days.

(21) Appl. No.: 14/511,212

(22) Filed: Oct. 10, 2014

(51) Int. Cl.
*B21D 1/14* (2006.01)
*B21D 1/06* (2006.01)
*B21D 1/08* (2006.01)

(52) U.S. Cl.
CPC *B21D 1/14* (2013.01); *B21D 1/145* (2013.01); *B21D 1/065* (2013.01); *B21D 1/08* (2013.01); *Y10S 72/705* (2013.01)

(58) Field of Classification Search
CPC ..... B21D 1/14; B21D 1/145; B21D 1/065; B21D 1/08; Y10T 72/705
USPC ..... 72/392, 705, 457
See application file for complete search history.

(56) References Cited

U.S. PATENT DOCUMENTS

| | | | | |
|---|---|---|---|---|
| 3,431,759 | A * | 3/1969 | Whittingham | B21D 7/06 72/369 |
| 4,400,968 | A * | 8/1983 | Barbieri | 72/457 |
| 4,949,569 | A * | 8/1990 | Young et al. | 72/392 |
| 5,101,654 | A * | 4/1992 | Stevens | 72/447 |
| 2004/0206859 | A1 * | 10/2004 | Chong | B25D 17/30 248/121 |

* cited by examiner

*Primary Examiner* — Shelley Self
*Assistant Examiner* — Mohammad I Yusuf
(74) *Attorney, Agent, or Firm* — Christian Sanchelima; Jesus Sanchelima

(57) ABSTRACT

An apparatus used to repair damage from metal body panels of a transportation container. The apparatus includes a platform having wheels that can optionally be locked. The apparatus further includes a pivoting arm that can be selectively raised, lowered, extended or retracted to repair virtually any area of a transportation container. At the end of the pivoting arm is a cross-arm member comprised of a piston repair arm that can be fitted with a plurality of attachments depending on the contours of the surface being repaired. The area to be repaired can include perimeter walls, ceilings, doorframes, and/or corner posts. The pivoting arm and piston repair arm are driven using a pneumo-hydraulic system that is lighter than any other system currently used on transportation repair devices. The substantial reduction in weight allows the apparatus to readily enter transportation containers and be easily handled by a single operator.

8 Claims, 15 Drawing Sheets

PNEUMO-HYDRAULIC SYSTEM FOR REPAIRING TRANSPORTATION CONTAINERS

BACKGROUND OF THE INVENTION

1. Field of the Invention

The present invention relates to a system for repairing transportation containers, and more particularly to a device that uses a pneumo-hydraulic driving means to repair damage from virtually any section along the inner surface of the transportation container, including perimeter walls, ceilings, door frames, and/or corner posts.

2. Description of the Related Art

Several designs for shipping container repair devices have been designed in the past. None of them, however, have implemented a pneumo-hydraulic drive means—lighter than what conventional shipping container repair devices use—to operate a pivoting arm that can be raised, lowered, extended and retracted. None include a piston repair arm to gradually be extended to repair damage on the inner surfaces of transportation containers. Also, none of the references in the prior art teach or suggest using a pivoting arm to position the piston repair arm in the proper location. Additionally, none include a plurality of accessories that can be fitted with the piston repair arm to more effectively repair surfaces having different contours and corner posts.

Applicant believes that the closest reference corresponds to U.S. Pat. No. 4,555,926 issued to Bieli, Moeschlin Ruedi for equipment for repairing and correcting dents or bulges in containers. However, it differs from the present invention because the Bieli reference teaches of an electric powered driving means for the pistons without the use of a pivoting arm that can position the repair piston in a safe and effective location. This makes for a much heavier apparatus that is more difficult to transport and operate. It would not be obvious to find a way to configure a pneumo-hydraulic driving means with this apparatus. The configuration of the pneumo-hydraulic driving means requires unexpected configurations to be made to the apparatus with respect to operating the pivoting arm and repair piston arm.

It is not obvious to any references in the prior art, individually or in combination, as evident in Bieli. The Bieli reference taught of needing a complicated arrangement of elements that are used to lift the device into a transportation container to be repaired. This complex arrangement is needed because of the significant weight associated with the electric driving means. The pneumo-hydraulic means of the present invention requires foot pedals, an air filter, and a series of conducts that would not be obvious to apply to the Bieli reference.

Additionally, the electric driving means causes Bieli to utilize a plurality of chains to achieve a predetermined height for the repair arm of the apparatus. In addition, it only teaches of a repair arm that can be raised and lowered, leaving absent a disclosure that teaches of a method to extend and retract the position of the repair arm. This flaw in the apparatus subject of the Bieli reference leaves out the important safety feature taught by the present invention. The ability to extend or retract the pivoting arm allows a user to separate him or herself from a work site that may expel harmful debris.

The electric powered driving means of the Bieli reference can also be subject to short circuits. The present invention uses a pneumo-hydraulic system to repair containers with none of the dangers associated with a short circuit or electrical hazards. If damage is done to the pneumo-hydraulic system, the worst that can happen is an air escape, a relatively harmless consequence.

Additionally, the present invention can be configured with a plurality of attachments to the piston repair arm to repair damage on virtually any section of a transportation container. Specifically, the present invention discloses of attachments that can be used to repair containers with wider or narrower contours along the surface of its inner walls, door frames, and/or corner posts. This versatility is not disclosed in the prior art as the related references are only designed for perimeter walls. Also, the present invention discloses a system that includes a pneumo-hydraulic assembly that can be easily detached from the platform of the apparatus. The prior references do not disclose or motivate one of ordinary skill in the art to include an assembly for its driving means that can be detached to reduce the weight of the device or so the driving means can be more ergonomically repaired or maintained.

Other documents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a lightweight, versatile, and easy to use device that repairs damage on any of the inner surfaces of transportation containers.

It is another object of this invention to provide such a versatile device that, more specifically, is designed to repair every section of a transportation container, including, all perimeter walls, ceilings, door frames, and corner posts.

It is another object of this invention to provide a lightweight device using pneumo-hydraulic driving means that significantly reduces the weight of the device allowing it to readily and easily be transported inside of transportation containers.

It is another object of this invention to provide a pneumo-hydraulic device with a plurality of attachments that cooperate with the inner walls of containers of different designs.

It is still another object of this invention to provide a device that does not rely on electrical power that can have much more dangerous consequences than the present invention.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which:

FIG. 5 shows an isometric view of the present invention with telescopic tubular arm 44 in the lowered position and extended position so as to clear platform 22 to reach work areas close to a bottom surface. Pneumo-hydraulic assembly 80 can be removed as shown to give it maintenance or perform repairs on the hydraulic system. Plate 102 can be seen protecting pedals 82; 82*a* while providing a user with a place to operate the device from.

DETAILED DESCRIPTION OF THE EMBODIMENTS OF THE INVENTION

Figure 1:
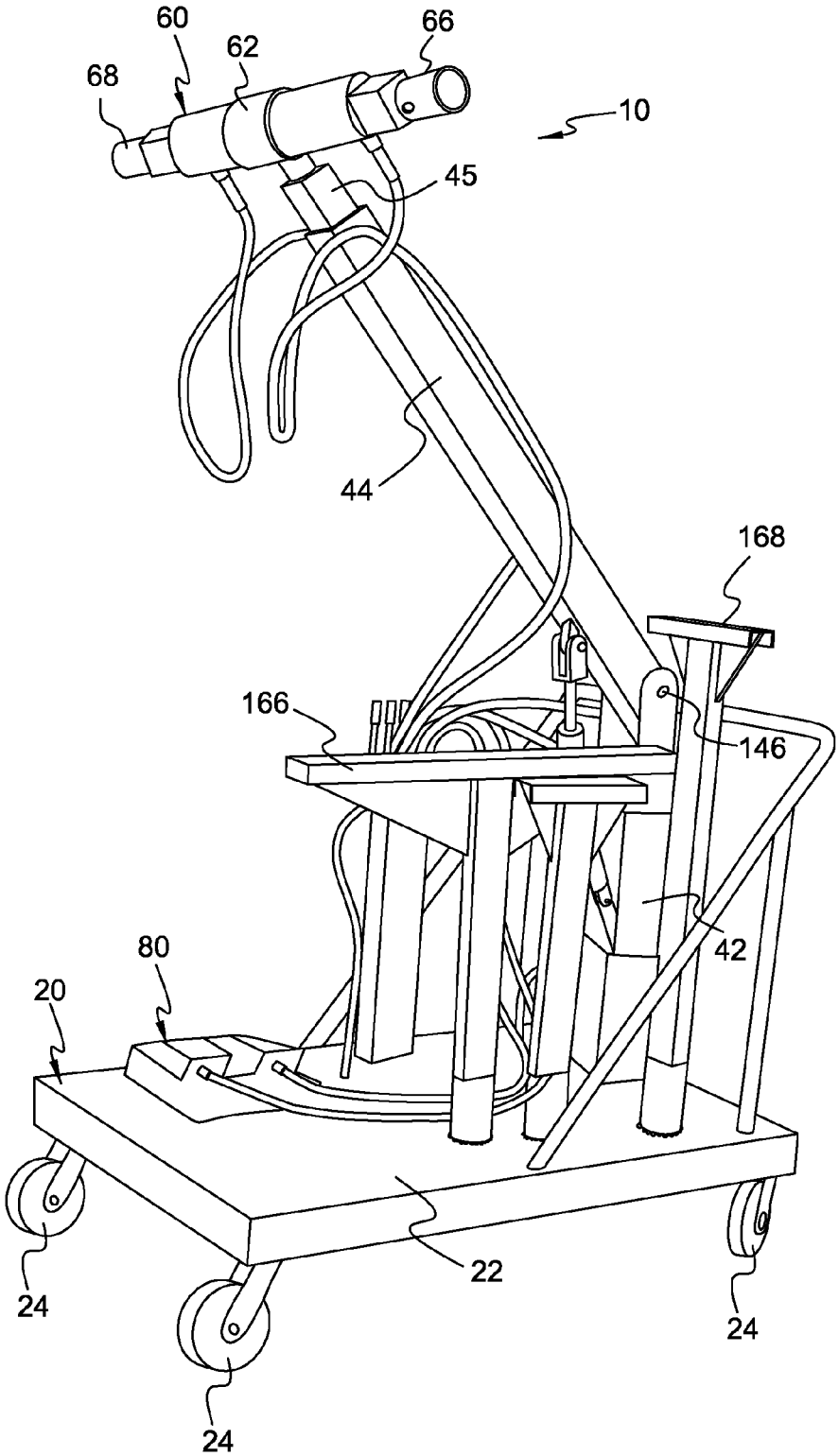
FIG. 1 shows an isometric view of the present invention showing telescopic tubular arm 44 in the raised position.

Referring now to the drawings, where the present invention is generally referred to with numeral 10, it can be observed that it basically includes platform assembly 20, pivoting arm, assembly 40, cross-arm assembly 60, pneumo-hydraulic assembly 80, and control panel assembly 100.

As shown in FIG. 1, platform assembly 20 includes platform 22 and wheels 24 that make it easy to transport the present invention. In an alternate embodiment shown in FIG. 2A, wheels 24 can include locking means 124. In an alternate embodiment shown in FIG. 2A, bracket member 126 can be rigidly mounted to platform 20 to provide a user an area on which to securely rest their foot while operating pneumo-hydraulic assembly 80. Additionally, bracket member 126 prevents pneumo-hydraulic assembly 80 from being accidentally actuated. Platform assembly 20 also includes rail 26 that is rigidly mounted to platform 22 so that a user can maneuver and position the apparatus.

Figure 2:
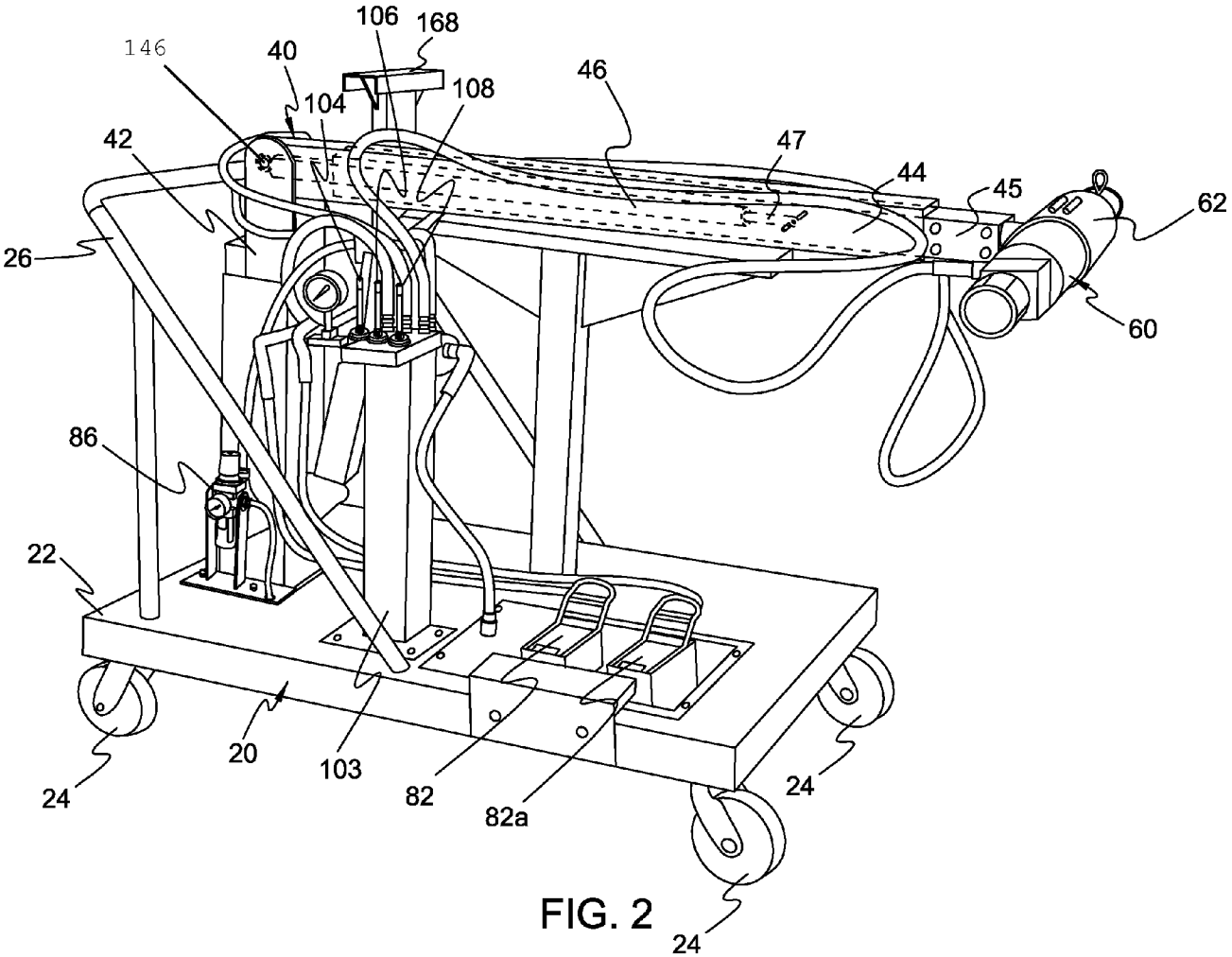
FIG. 2 is an isometric view of the present invention showing telescopic tubular arm 44 in the partially lowered position.

As seen in FIG. 2, pivoting arm assembly 40 is rigidly mounted to platform 20 using vertical structural member 42. Pivoting arm assembly 40 further includes outer telescopic tubular arm 44 that is hingedly mounted to vertical structural member 42 using hinge 146. As shown, in FIG. 2, outer telescopic tubular arm 44 houses inner telescopic tubular arm 45. Inner telescopic tubular arm 45 houses piston 46 that can extend or retract inner telescopic tubular arm 45. As seen in FIG. 2B, pivoting arm assembly 40 also includes height-positioning piston 48 that is mounted to platform 20 and at the other end is mounted to telescopic tubular arm 44. As seen in FIG. 2, piston 46 includes rod 47 that pushes or pulls inner telescopic tubular arm 45. Height-positioning piston 48 is hydraulically powered to control the inclination angle of telescopic tubular arm 44 with respect to vertical structural member 42, thereby adjusting the desired height for cross-arm assembly 60.

Figure 3:
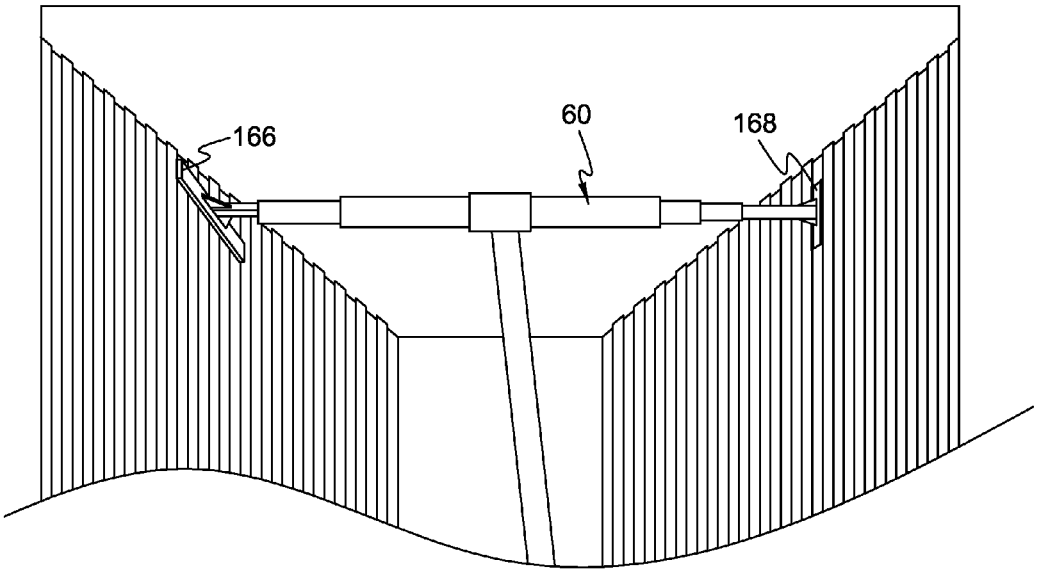
FIG. 3 illustrates a front view of the present invention wherein support member 166 is supporting the present invention against one perimeter wall while repair member 168 is repairing an opposite perimeter wall.
Figure 3B:
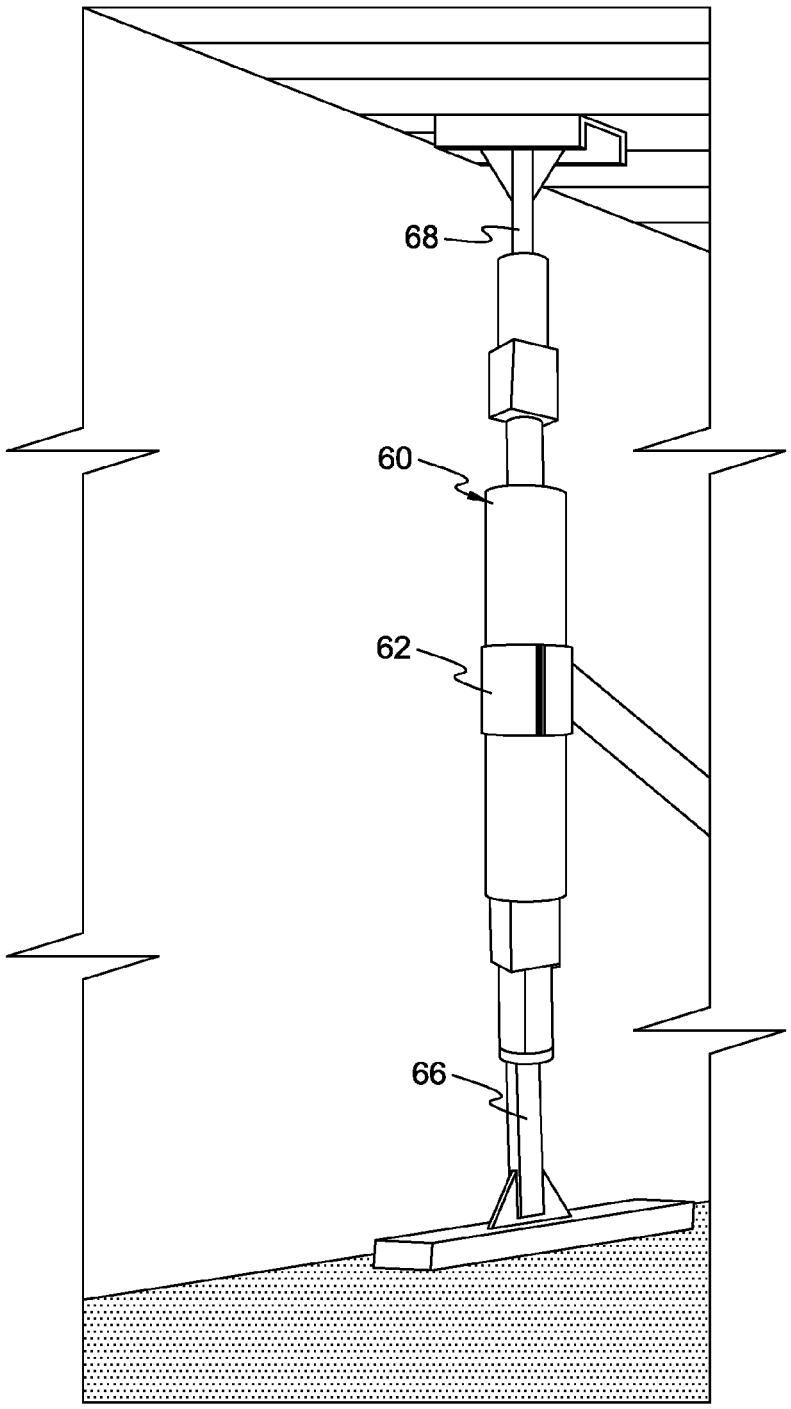
FIG. 3B is a detailed front view of the present invention wherein cross-arm assembly 60 has been vertically disposed to repair the ceiling of a container.
Figure 3C:
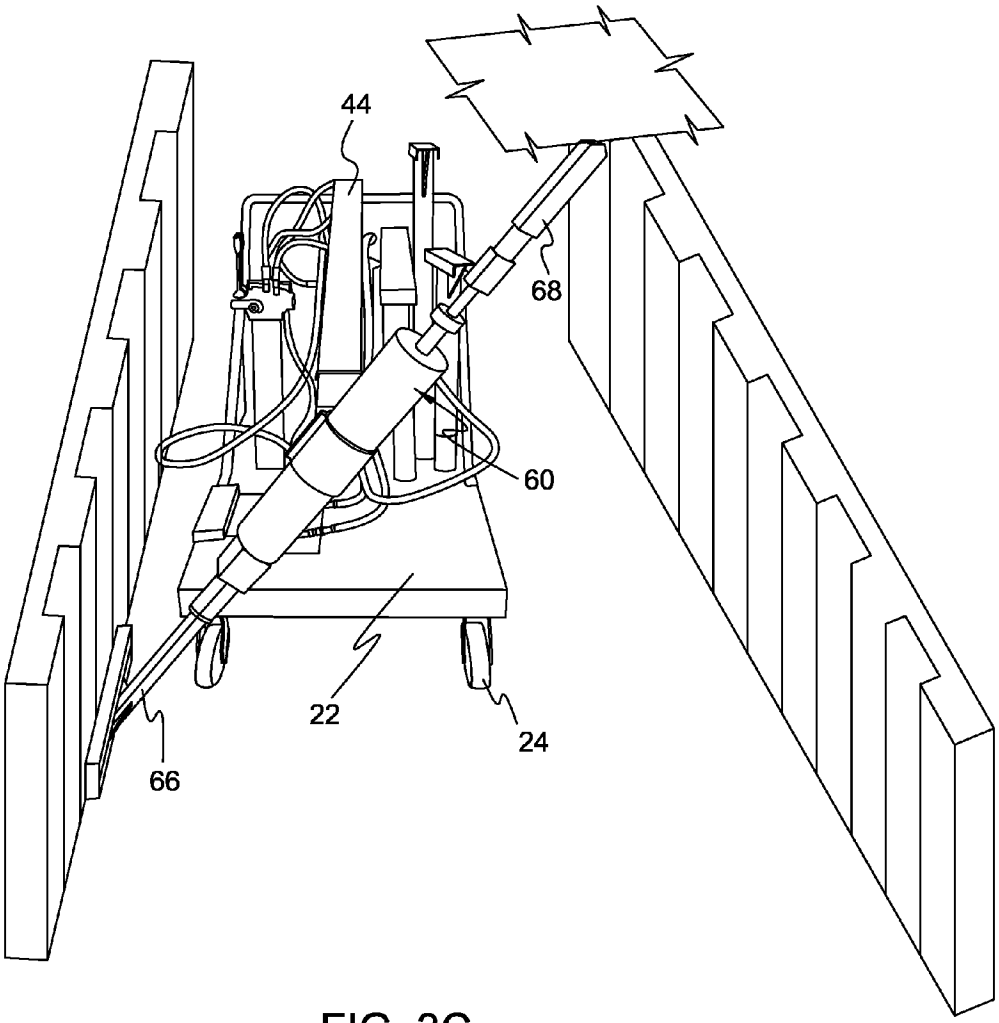
FIG. 3C is a top isometric view of the present invention wherein cross-arms assembly 60 has been diagonally disposed to repair the corner post of a container.
Figure 4:
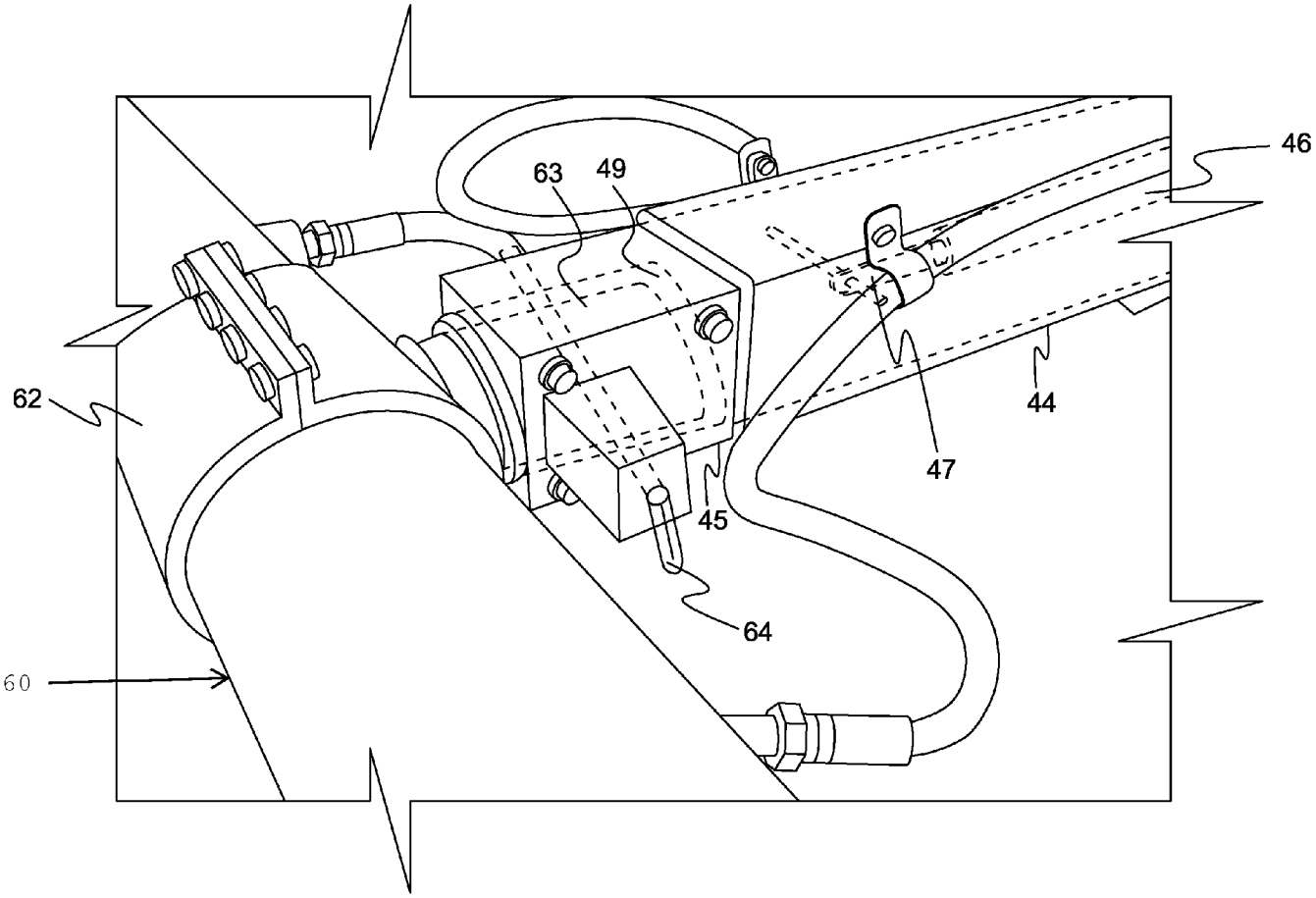
FIG. 4 is a representation of an enlarged view of clasp sleeve member 62 shown mounted to cross-arm assembly 60. Sleeve extension 63 can be seen cooperatively inserted into sleeve housing 49 of inner telescopic tubular arm 45 and locked using sleeve locking member 64.
Figure 4A:
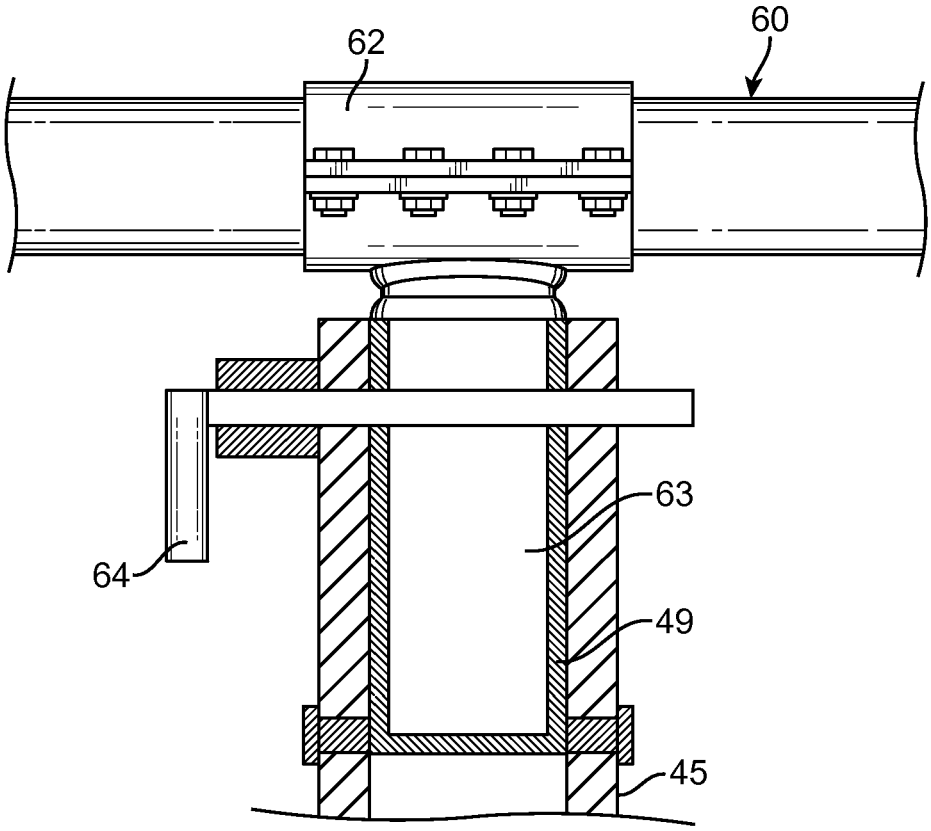
FIG. 4A is a partial cross-sectional view of the present invention wherein sleeve extension 63 can be seen mounted to inner telescopic tubular member 45 by being inserted into sleeve housing 49 and locked in place using sleeve locking member 64.

As seen in FIG. 4, cross-arm assembly 60 includes a clasp sleeve member 62 that is ratably mounted to the distal end of telescopic tubular arm 44. Clasp sleeve member 62 has sleeve extension member 63 extending from its distal end. Clasp sleeve member 62 is inserted into sleeve housing 49 which permits sleeve extension 63 to rotate. Accordingly, cross-arm assembly 60 can be rotated 360 degrees about inner telescopic tubular arm 45 and locked into a selected position using locking pin 64. Clasp sleeve member 62 can be opened to receive cross-arm assembly 60 and is of a diameter to cooperatively close entirely around the approximate midpoint of cross-arm assembly 60, as represented in FIGS. 3-3B.

Figure 3A:
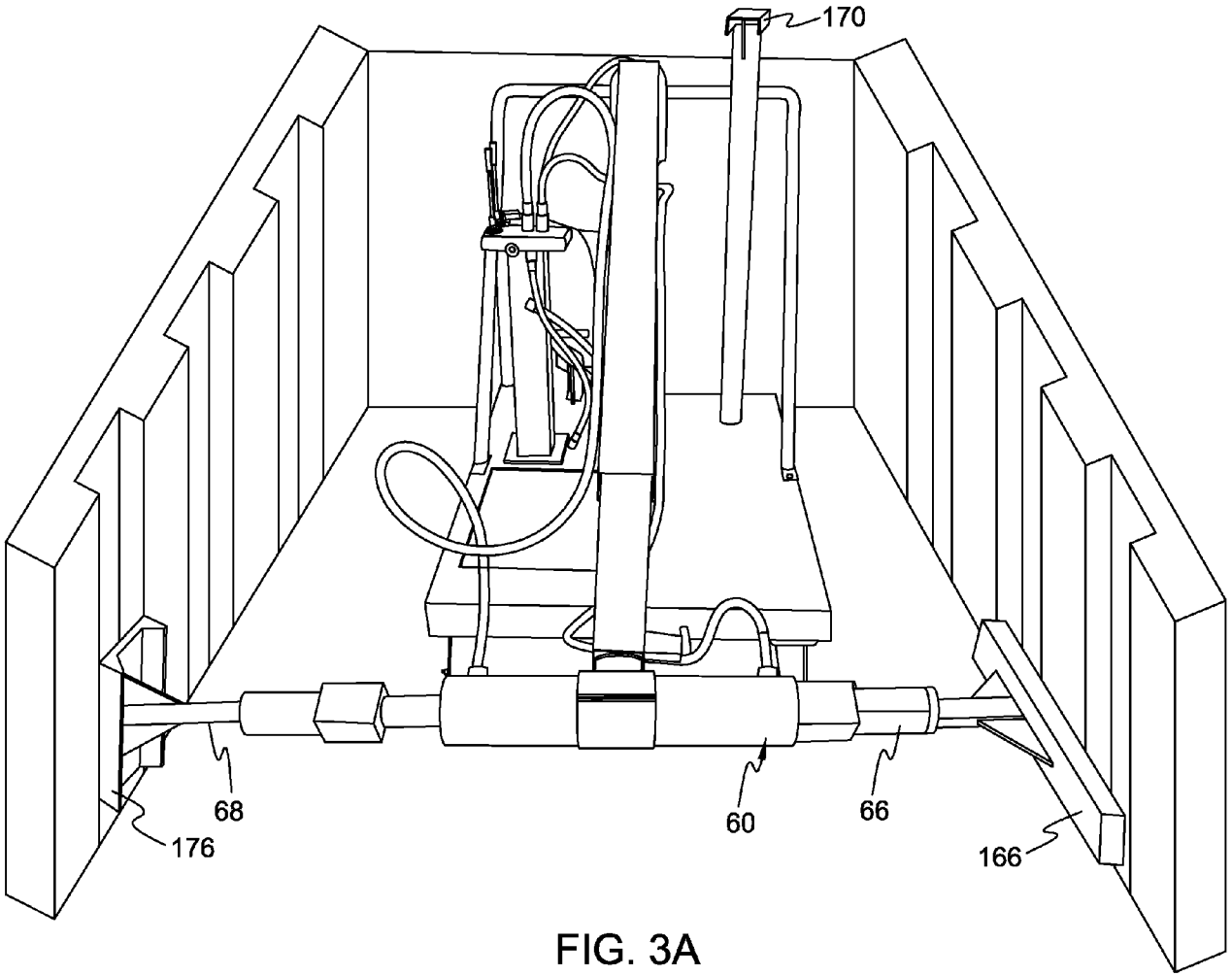
FIG. 3A is a detailed front view of the present invention showing support member 166 against the corrugated design of a perimeter wall while repair attachment 176 is flush against the recessed area of the perimeter wall to be fixed.

As seen in FIG. 3A, cross-arm assembly 60 includes tubular arms 66 and 68 disposed opposite of each other. Tubular arm 66 has at its distal end an attachment, such as support member 166 removably mounted thereon. Tubular arm 68 has an attachment, such as repair member 176 at its distal end removably mounted thereon. As shown in FIGS. 3-3B, when repairing a surface within a transportation container, support member 166 is pressed against an inner surface while repair member 168 is gradually pushed towards a surface to be repaired using a piston mechanism located within tubular arms 66; 68. Utilizing Newton's Third Law of Motion, support member 166 pushing against an inner surface provides a reactionary force transferred and applied to the tubular arm 68 and subsequently to the repair attachment chosen, thereby reducing the amount of force required by piston means within tubular arm 68. In one embodiment, repair member 168 can be chosen as an attachment and is gradually pushed against a site to be repaired. It is pushed against the damage area until the damage is pushed back in and the surface is straightened or returns to its initial form.

Figure 1A:
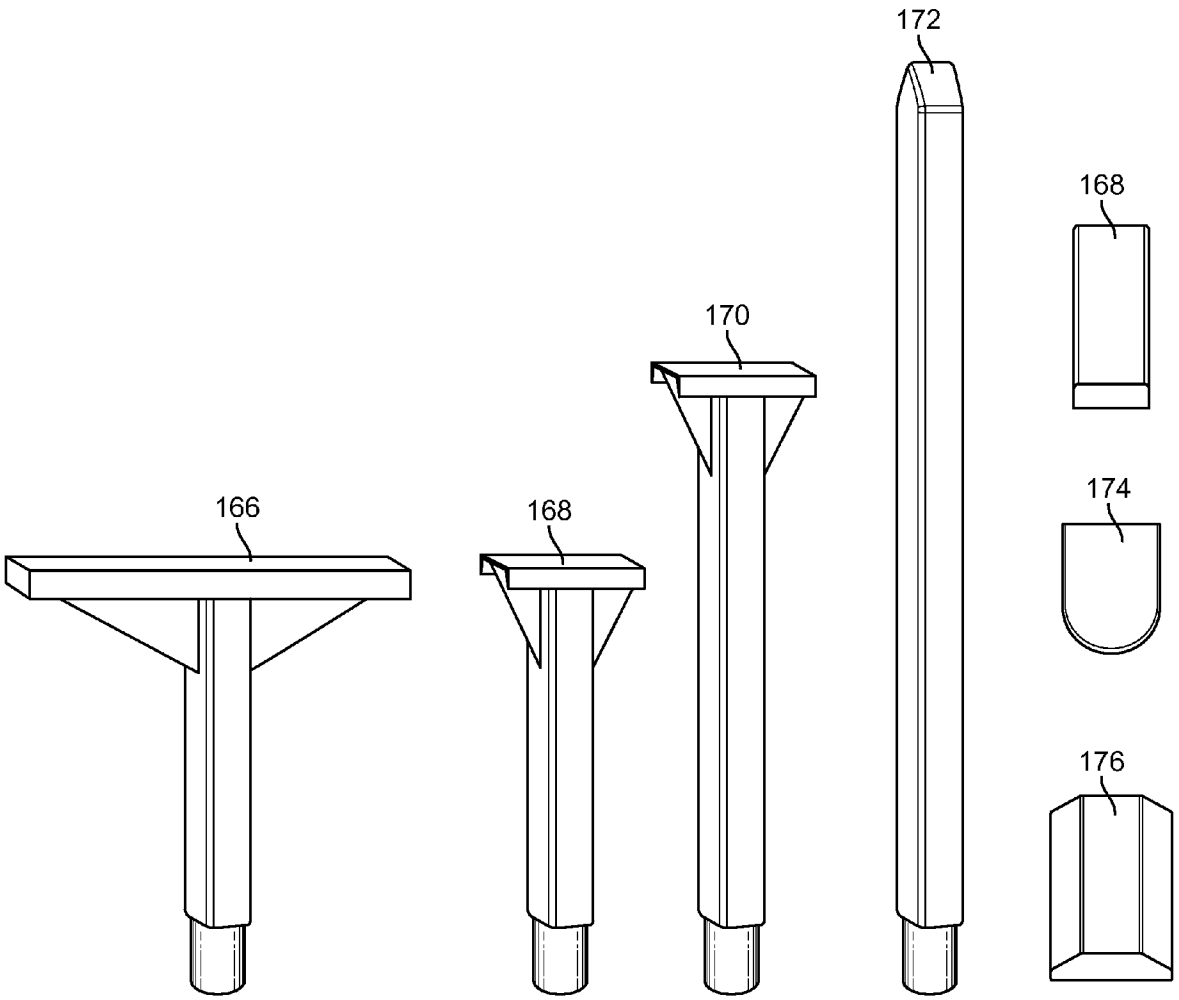
FIG. 1A shows a front elevational view of a plurality of accessories that the apparatus can be fitted with to repair various areas of a shipping container.
Figure 7:
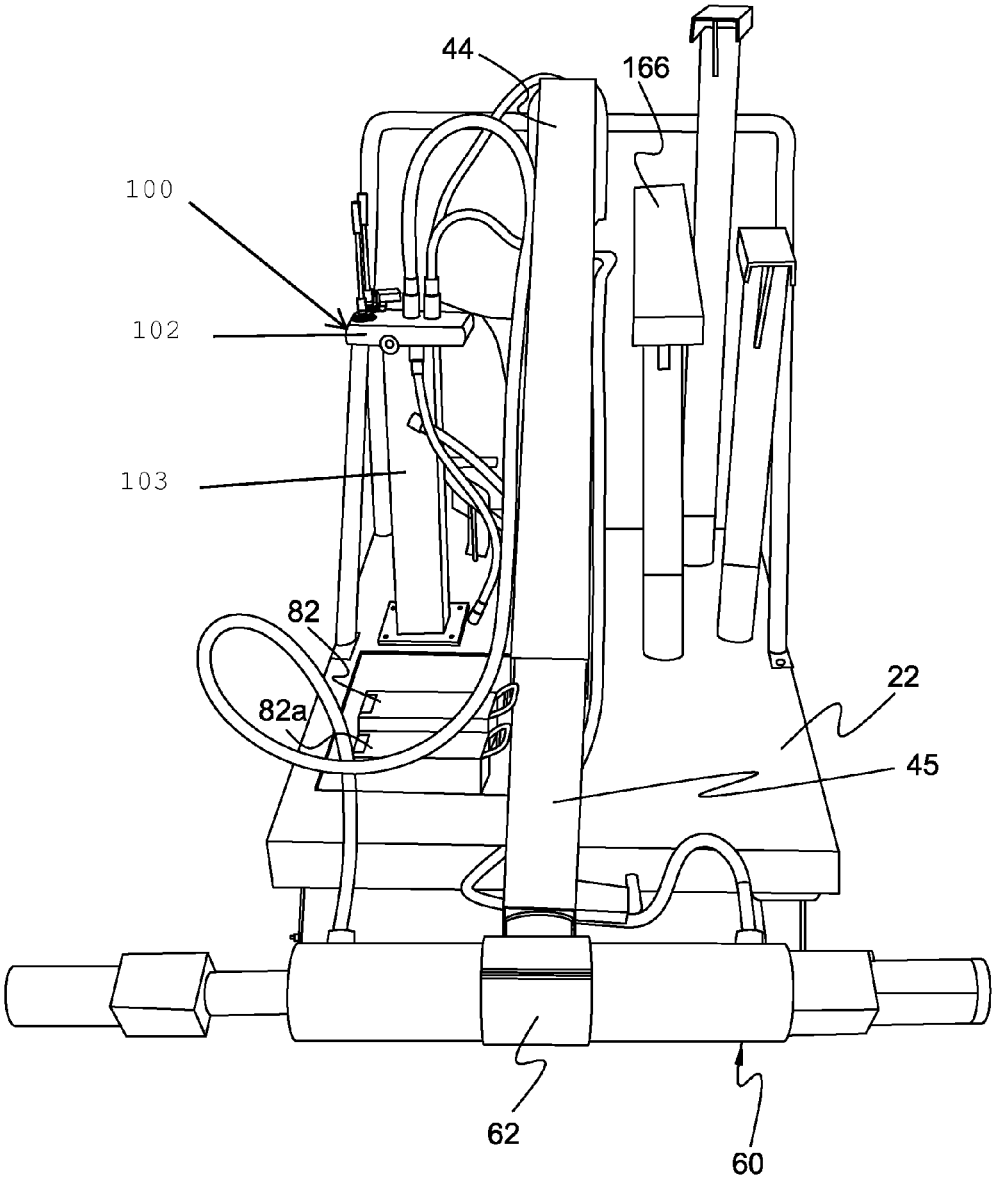
FIG. 7 illustrates a front elevational view of the present invention wherein cross-arm assembly 60 can be seen in the lowered and extended position.
Figure 8:
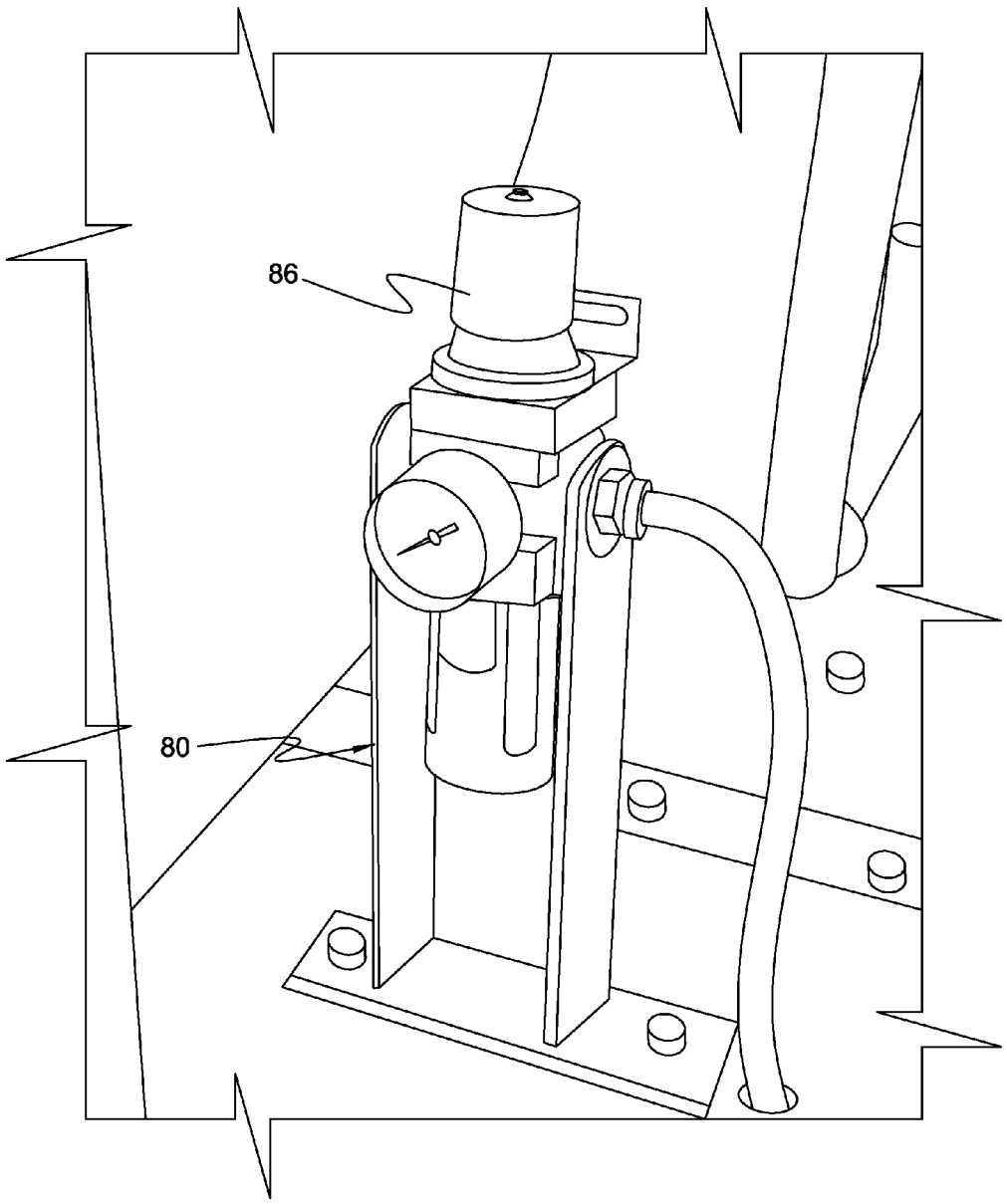
FIG. 8 is a partial representation of pneumo-hydraulic assembly 80 showing air filter 86.

In an alternate embodiment, seen in FIG. 1A, repair member 168 can be replaced a plurality of attachments. Repair member 168 can be replaced with longer variant, extended repair member 170. Repair member 168 can also be replaced with pointed repair member 172 used to repair corner posts of a transportation container and the corners of its doorframes. Support member 166 can be seen in FIG. 1A. A flat design seen in a top view of repair member 168 is shown, however, depending on the transportation container, U-shape design member 174 or corrugated design member 176 may need to be used. As shown in FIG. 7, the various attachments can be stored on platform 22 to be readily available to a user.

Figure 2A:
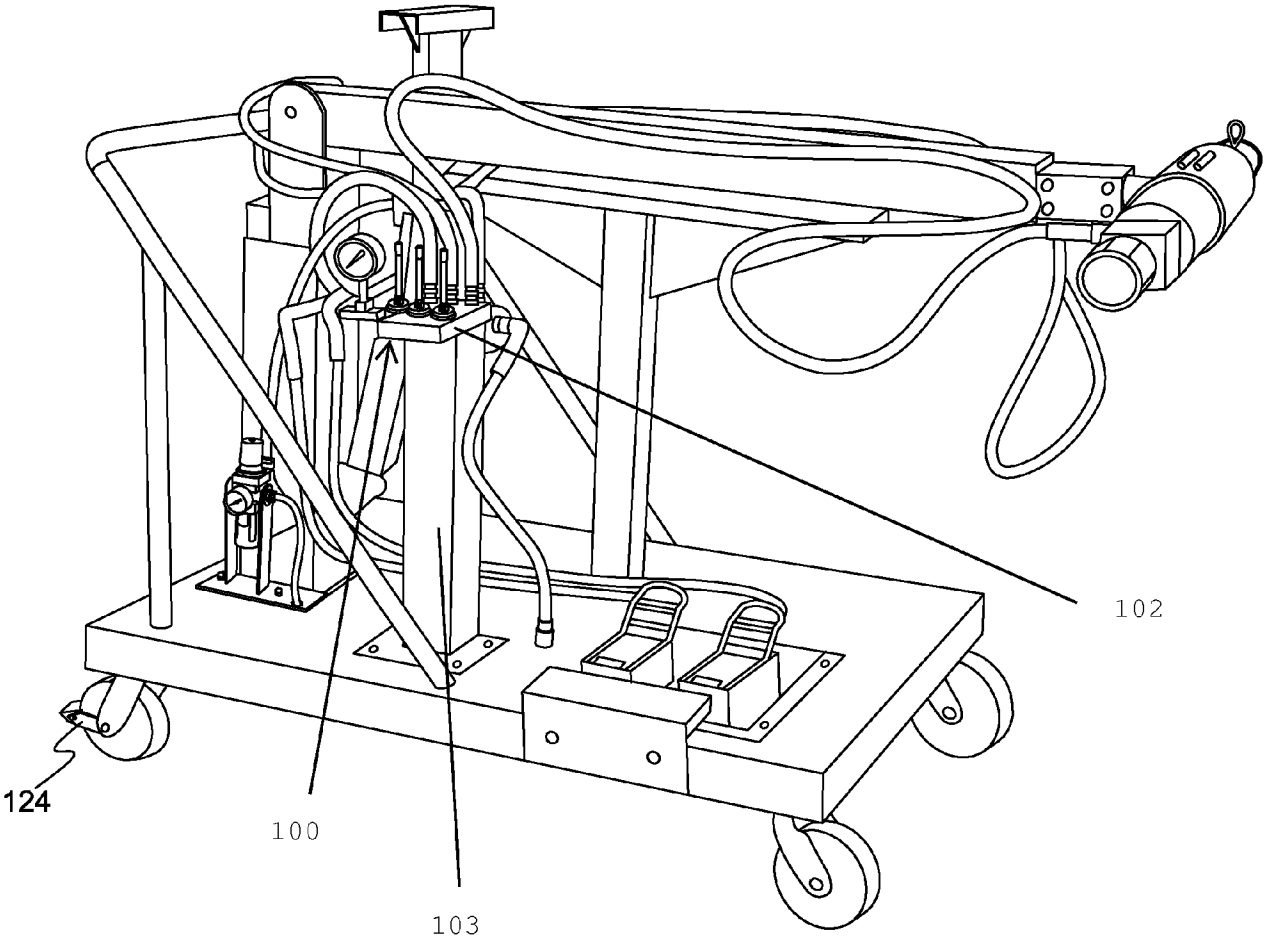
FIG. 2A represents an isometric view of an alternate embodiment of the present invention in the partially lowered position having wheel locking means 124.
Figure 2B:
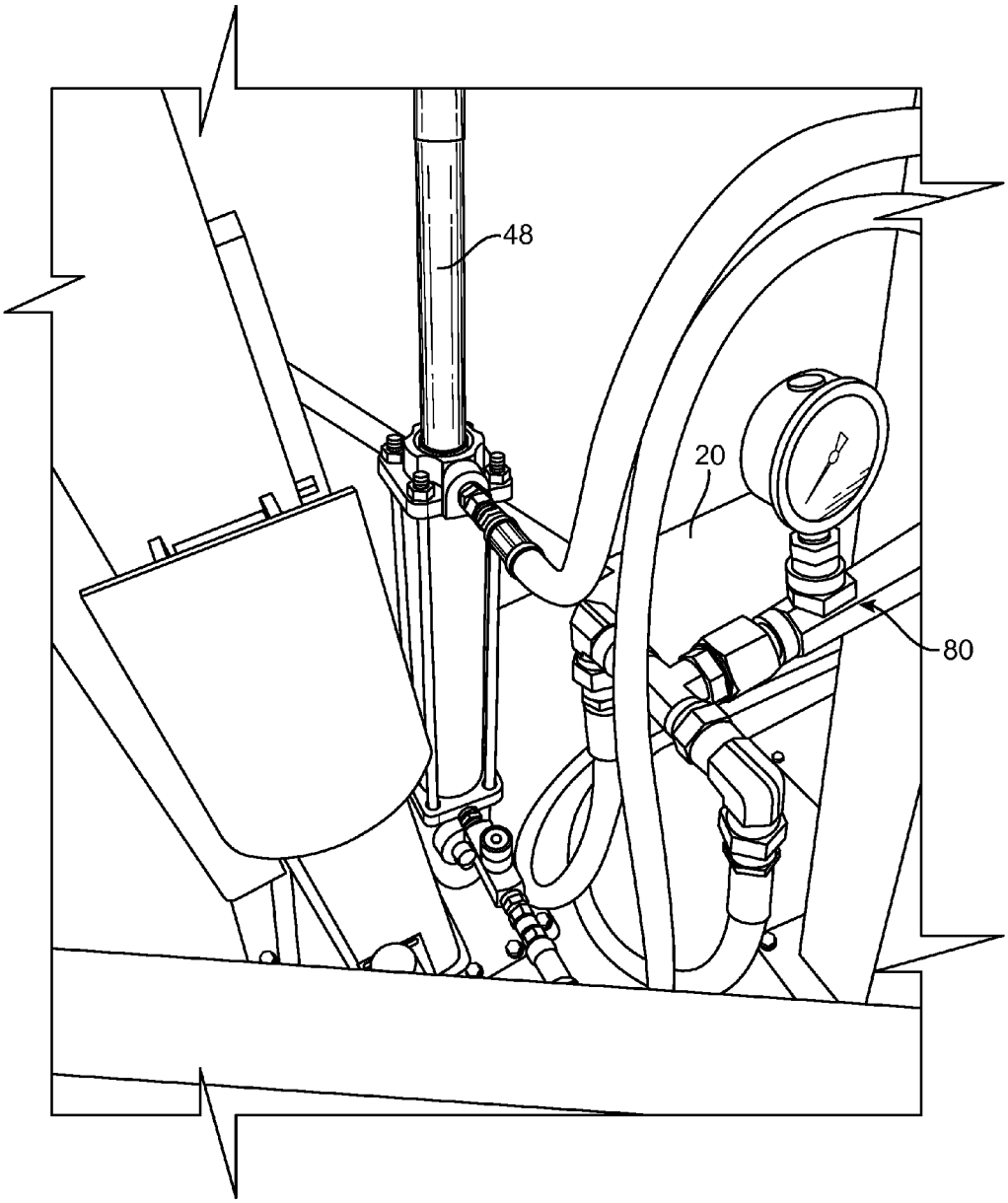
FIG. 2B is an enlarged partial isometric view of the present invention wherein height positioning piston 48 is shown.
Figure 5:
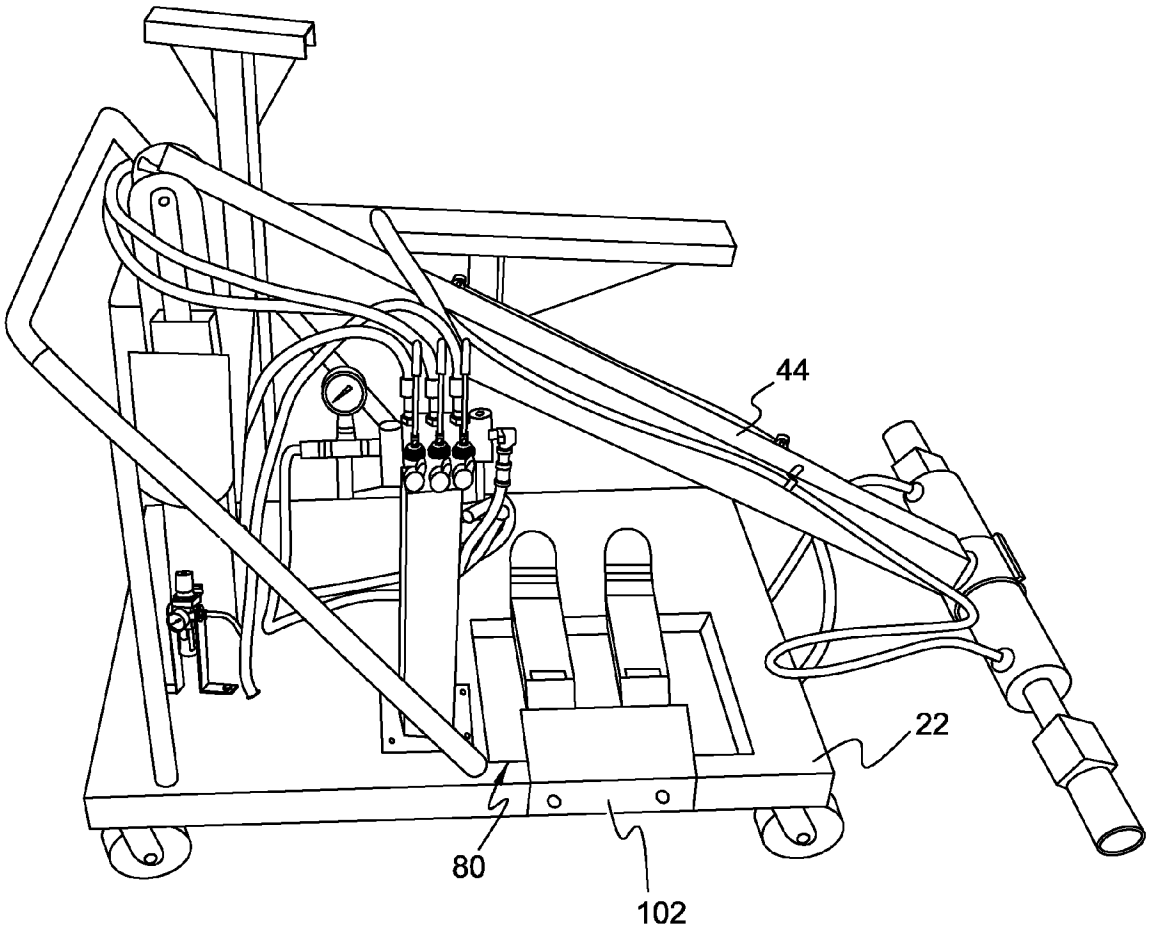
Figure 6:
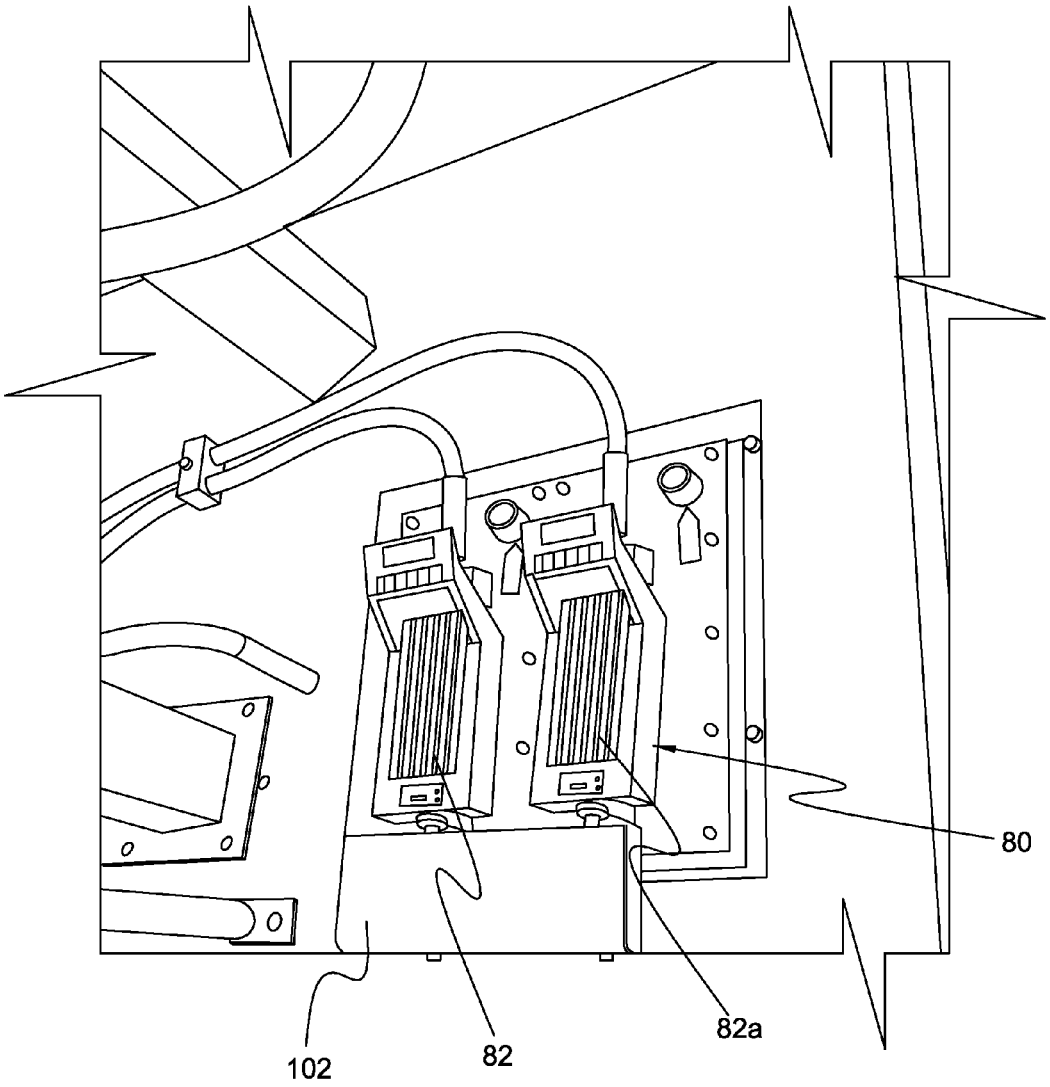
FIG. 6 represents an enlarged view showing foot pedals 82; 82*a* that control the exchange of hydraulic fluid to control panel assembly 100.

As shown in FIGS. 2, 2A and 5, pneumo-hydraulic assembly 80 is detachably mounted to platform 22. As seen in FIG. 2, pneumo-hydraulic assembly 80 includes pedals 82; 82*a*. Pneumo-hydraulic assembly 80 also includes a hydraulic tank underneath platform 22. Pneumo-hydraulic assembly 80 further includes air filter 86. Air filter 86 receives pressurized air through an air pressure input means from an eternal source and filters out debris before the pressurized air is sent to hydraulic tank 84. When a user presses down on pedals 82; 82*a*, the hydraulic fluid—powered by the pressurized air—is released to control panel assembly 100 through a supply conduit and is returned to the hydraulic tank using a supply return conduit, as shown in FIG. 6. In an alternate embodiment, pneumo-hydraulic assembly 80 can be removed from platform 22 to be serviced or to reduce the weight of the apparatus during transportation.

As seen in FIGS. 2A and 7, control panel assembly 100, in one of the embodiments, has plate 102 that rests on upright structural member 103 rigidly mounted to platform assembly 20. Plate 102 supports a plurality of levers that control the travel of the hydraulic fluid inside conduits the conduits that actuate piston 46, height-positioning piston 48 and the piston mechanism within tubular arms 66; 68.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An apparatus used to repair transportation containers, comprising:

a) a platform;

b) a fixed vertical structural member mounted to said platform, said fixed vertical member hingedly mounted to a telescopic pivoting arm, said telescopic pivoting arm being able to raise and lower to a predetermined height as well as able to extend or retract a predetermined distance;

c) a cross-arm member mounted to the distal end of said pivoting arm, said cross-arm member including a first tubular member having a repair member at its distal end that is gradually pushed against surfaces of said transportation containers to repair dents or similar damage, said cross-arm member further including a second tubular member opposite to said first tubular arm, said second tubular arm includes a support member at its distal end to engage the surface opposite the surface being repaired thereby providing support and stability to said apparatus;

d) a ratably mounted sleeve member mounting said cross-arm member to said pivoting arm, said rotably mounted sleeve member includes a sleeve extension inserted into a housing located at the distal end of said telescopic pivoting arm that allows said cross-arm member to be rotated about a 360 degrees axis with respect to said pivoting arm;

e) fastening means to secure said cross-arm member in a predetermined position;

g) a removable pneumo-hydraulic assembly including at least one hydraulic tank, two hydraulic pedals and a plurality of hoses to provide driving means to said pivoting arm's articulations and said first tubular arm, said pneumo-hydraulic assembly detachable from said platform so that said apparatus is more easily transported and so that said pneumo-hydraulic assembly is more ergonomically maintained and repaired;

h) an air pressure input means to receive pressurized air from an external source, said input means being connected to said pneumo-hydraulic assembly, whereby said air pressure input means drives said pneumo-hydraulic assembly; and i) a control unit allowing a user to selectively adjust the height or extension of said pivoting arm or the extension of said first tubular arm.

2. The apparatus set forth in claim 1 wherein said fastening means to lock said pistons in a predetermined position is a locking pin.

3. The apparatus set forth in claim 1 wherein said fastening means to lock said pistons in a predetermined position is a screw.

4. The apparatus set forth in claim 1 wherein said platform includes a bracket member adjacent said pneumo-hydraulic assembly configured to provide a user an area to rest their feet while operating said pneumo-hydraulic assembly.

5. The apparatus set forth in claim 1 wherein said repair pad can be one of several attachments that conform with the contours of preselected areas of said transportation container to be repaired.

6. The apparatus set forth in claim 5 wherein one of said accessories is designed to conform to a corner post of said transportation container.

7. The apparatus set forth in claim 1 wherein said platform includes wheels.

8. The apparatus set forth in claim 5 wherein said wheels including locking means to prevent said apparatus from moving.

* * * * *